United States Patent [19]

Martin

[11] Patent Number: 4,940,078

[45] Date of Patent: Jul. 10, 1990

[54] OIL RING FOR CASTING

[75] Inventor: Diane D. Martin, Lafayette, Ind.

[73] Assignee: Aluminum Company of America, Pittsburgh, Pa.

[21] Appl. No.: 278,216

[22] Filed: Nov. 30, 1988

[51] Int. Cl.[5] ..... B22D 11/07

[52] U.S. Cl. ..... 164/472; 164/440; 164/490; 164/268

[58] Field of Search ..... 164/440, 472, 490, 268

[56] References Cited

U.S. PATENT DOCUMENTS 3,451,465 6/1969 Moritz ..... 164/440

4,699,200 10/1987 Sedlacek ..... 164/472

*Primary Examiner*—Nicholas P. Godici

*Assistant Examiner*—Edward Brown

*Attorney, Agent, or Firm*—Daniel A. Sullivan, Jr.

[57] ABSTRACT

Oil rings of increased life are provided on the basis of compositions selected to provide increased effective amounts of lattice-contracting atomic species.

11 Claims, 1 Drawing Sheet

OIL RING FOR CASTING

TECHNICAL FIELD

The invention relates to apparatus and method useful for continuous casting of molten material into ingot form. The word "continuous" is meant to designate processes where metal, for example, goes in the molten state in one end of a mold and leaves the other end of the mold in the solid state in a continuous manner. It is recognized that "continuous" does not usually mean "forever" and that the process will often be terminated when a desired ingot length has been achieved. The invention is applicable as well, however, to processes where continuously cast metal is immediately processed further, for instance rolled into sheet; in such cases, the process need, in theory, never be terminated.

BACKGROUND ART

In the continuous casting of metals, such as aluminum and alloys thereof, the molten metal is poured into a mold having sidewalls and a starting block or wall which moves away from the sidewalls during casting. When molten metal is flowed into the mold, it rapidly solidifies from the effect of a coolant, usually water, which is, for instance, continuously sprayed on the exterior of the sidewalls. The starting block is moved away from the mold at a rate commensurate with the introduction of molten metal into the mold. Concurrently, a lubricant is continuously supplied to the interior sidewall surfaces of the mold to enhance movement of the solidified ingot with the starting block. Thus, a long ingot of metal is continuously produced.

In a method of providing the lubricant, such as oil, a continuous groove is cut in the end of the mold around the mold opening to function as a reservoir for the oil. A plurality of slots are cut in the mold from the oil groove to the mold interior, and oil from the groove flows through the slots and onto the interior mold surface. A cover plate, the oil ring, is fastened to the end of the mold over the oil reservoir groove in order to retain the oil therein. The inside dimensions of the oil ring are critical to insure that its assembly with the mold is suitable to enable lubrication of the mold and not interfere with the casting of the ingot. Typically, the metal first solidifies at the inner periphery of the oil ring and subsequently slides along the interior sidewall surfaces of the mold.

Examples showing oil rings situated as they are used in continuous casting are provided by U.S. Pat. Nos. 3,381,741 and 4,699,200, which are incorporated here by reference. The oil ring is designated "insert 22" and "insert 58" in U.S. Pat. No. 3,381,741 and "oil ring 30" in U.S. Pat. No. 4,699,200.

In the continuous casting of aluminum alloys, state of the art before the present invention has been to manufacture aluminum oil rings from aluminum alloys 3003 and 5052 (aluminum alloys mentioned herein, such as aluminum alloys 3003 and 5052, are as defined in the "Registration Record of Aluminum Association Designations and Chemical Composition Limits for Wrought Aluminum and Wrought Aluminum Alloys", the Aluminum Association, Washington, D.C.).

It is also known to use copper oil rings for the continuous casting of aluminum alloys.

DISCLOSURE OF INVENTION

Oil rings are used in continuous casting processes to disperse oil evenly, minimize oil contact with the header containing the molten feed metal, and provide the site for initiating solidification.

Oil rings are subjected to rather unusual conditions during use. While the oil ring temperature during casting of an aluminum alloy may only amount to 200° F. through most of the ring, the inner periphery is exposed essentially to the liquidus-solidus temperature range of the alloy being cast. Additionally, the inner periphery is exposed at these high temperatures to the tearing, sliding action of newly solidified metal as it breaks away from the inner periphery of the oil ring to follow the motion of the starting block out of the mold.

With repeated use, oil rings of the aluminum alloys 3003 and 5052 expand increasingly inwards, towards the center of the ingot; that is, the inner diameter (or, more generally, inner dimensions, since oil rings may be rectangular, elliptical, or other shapes) becomes smaller. This expansion results in increased lapping and surface deterioration on the ingot. Life of the 3003 and 5052 oil rings is therefore limited to a few drops (a "drop" is the production of one ingot). This increases downtime at the casting unit and provides a less consistent ingot product. While experiments have been conducted to attempt to find other aluminum alloys, to my knowledge, the 3003 and 5052 alloys had remained unsupplanted to the time of the present invention. Alloys 3003 and 5052 are examples of non-heat treatable alloys. Experiments with oil rings of the heat-treatable aluminum alloy 6061 were conducted, such being the alloy used for making the continuous casting mold, but 6061 proved to be less attractive than the alloys 3003 and 5052.

It has been the practice in the art, for the most part, just to tolerate the limited life of the 3003 or 5052 oil ring. To the extent that, in certain instances, a 3003 or 5052 oil ring has been unacceptable, practice in the art has been to change the materials family, i.e. a change to copper. By a "materials family" is meant a group of materials whose main ingredient is a given element. Thus, in the materials family, aluminum alloys, the main ingredient is aluminum. By "main" I mean that element which is present at the greatest percentage.

An object of the invention is to provide oil rings of greater useful life for continuous casting processes.

This and other objects which will become apparent on the basis of the description taken as a whole are achieved according to the invention as follows.

To overcome the problem of early deterioration of oil rings, the present invention provides an oil ring constructed of a materials family composition which contains an atomic species at a level providing a greater amount of solute-caused lattice-contraction than the level of the most effective contracting agent in the composition previously used for oil ring construction in such family. This atomic-scale definition of my invention may someday prove to have its exceptions, but it is on the basis of this manner of thinking that I selected aluminum alloy 2219 as a substitute for the previously used aluminum alloy 3003, and alloy 2219 has proven extremely successful in providing much greater oil ring life than previously achieved with 3003.

In defining this invention for continuous casting, I draw on a study of Hunsicker in the field of heat treating aluminum alloys, citation: Hunsicker, H. Y., "Dimensional Changes in Heat Treating Aluminum Alloys", *Metallurgical Transactions*, XIA (1980), 759–73. This study is here incorporated by reference. Hunsicker shows the effect of different elements on contracting or expanding the aluminum lattice. While the Mn in 3003 has a tendency to contract the Al lattice when it goes into solution, the solubility of Mn in Al is relatively low. Copper, although less effective than Mn in causing contraction of the aluminum lattice, has a relatively high solubility in Al. An alloy with 6% Cu contracts approximately 3 times more than 3003 with 1.1% Mn.

According to a preferred form of the invention, the oil ring thus is constructed of a copper-containing aluminum alloy containing 1 to 8% Cu, e.g. an aluminum alloy of the 2XXX series, rather than the manganese-based 3003 alloy previously used. Percentage compositions given herein are on a weight basis, unless indicated otherwise. Compositions herein are understood to be open to impurities and incidental elements.

With the increased oil ring life obtained by the present invention comes the advantages of
increased oil ring life,
increased header life,
decreased downtime at unit,
decreased man hours for tool set up, and
increased surface quality consistency.

MODES FOR CARRYING OUT THE INVENTION

Figure 1:
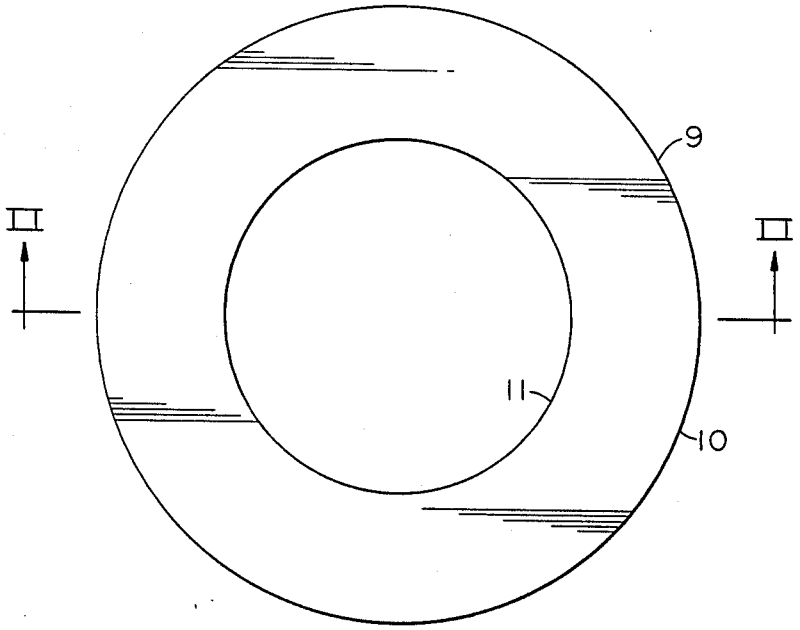
FIGS. 1 and 2 are, respectively, plan and cross sectional views of an oil ring of the invention.
Figure 2:
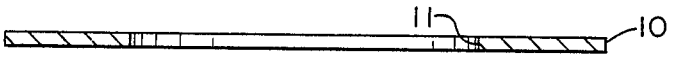
Figure 3:
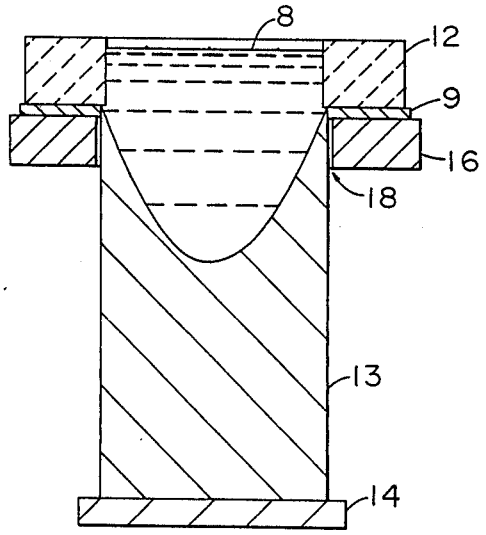
FIG. 3 is a schematic illustration of use of the oil ring of FIGS. 1 and 2 in a continuous casting process.

A typical oil ring 9 according to the present invention is shown in FIGS. 1 and 2, while FIG. 3 is a schematic illustration of an example of use of the oil ring. Oil rings of the invention are, in general, flat pieces of metal having an outer periphery 10 and an inner periphery 11; they may be circular, as shown, rectangular, or any other suitable shape, at least the shape of the inner periphery being determined by the cross sectional shape desired in the ingot which is being cast. Grooves may be provided on one of the flat surfaces of the oil ring, in support of its oil directing function.

The schematic of FIG. 3 illustrates a typical continuous casting process, where molten metal 8, such as a molten aluminum alloy, contained by refractory header 12 solidifies first on the inner diameter of oil ring 9 and continuously moves in the form of ingot 13 with starting block 14 away from mold 16. Lubricant flows between oil ring 9 and mold 16 into the interface between the mold and the ingot at gap 18. Gap 18 has been drawn relatively larger than it is in proportion to the other elements, in order to emphasize the inwardly protruding feature of the oil ring. In actual practice, the oil ring inner diameter will be only a few thousandths of an inch less than the inner diameter of the mold, and it is important that this difference not become greater due to inwardly directed expansion of the oil ring, i.e. lessening of the oil ring inner dimensions.

While the schematic of FIG. 3 shows vertical, or FDC, continuous casting, the invention as well may be applied in the case of horizontal, or HDC, continuous casting. The above-cited 3,381,741 contains examples of both vertical and horizontal casting.

Further illustrative of the present invention are the following examples:

EXAMPLE I

Aluminum alloy 2219-O, with a 6.5% Cu content and minimal lattice-expanding Mg, was chosen as the material for a 22-inch inner diameter oil ring.

Use of a 2219-O oil ring significantly increases oil ring life. For example, the life may be ten times greater than achieved using alloy 3003.

The designation "O" means the annealed condition of the alloy. The annealed condition is preferred for maximum dimensional stability. In the annealed state, an equilibrium between the different phases in the alloy has been achieved, so that on-going precipitation is not present to cause dimensional changes during service of the oil ring.

A generic definition of this species of the invention is the alloy group 2X19, thus including the 2219-related alloys 2319 and 2419.

EXAMPLE II

The alloy 2219 of Example I may actually have too much lattice contraction. The lattice contracting effect of Cu may be tempered by using magnesium in the composition. Thus, in this example of the invention, aluminum alloy 2024-O is used for oil ring construction. Content of the lattice contractor Cu is somewhat lower than in alloy 2219, and Mg is present as a solute species which acts as a lattice expander.

A generic definition of this species of the invention is the alloy group 2X24, thus including the 2024-related alloys 2124, 2224, and 2324.

While the invention has been described in terms of preferred embodiments, the claims appended hereto are intended to encompass all embodiments which fall within the spirit of the invention.

What is claimed is:

1. A method of using a flat ring comprising an alloy of 1 to 8% copper, balance aluminum, said method comprising situating the ring as an oil ring in a continuous casting apparatus for casting aluminum or aluminum alloy.

2. A method as claimed in claim 1, said alloy of said ring being a 2XXX-series aluminum alloy.

3. A method as claimed in claim 2, said alloy of said ring being 2X19 aluminum alloy.

4. A method as claimed in claim 3, said alloy of said ring being 2219-O.

5. A method as claimed in claim 1, said alloy of said ring further containing magnesium for tempering the lattice-contracting effect of the copper.

6. A method as claimed in claim 5, said alloy of said ring being a magnesium-containing 2XXX-series aluminum alloy.

7. A method as claimed in claim 6, said alloy of said ring being 2X24 aluminum alloy.

8. A method as claimed in claim 7, said alloy of said ring being 2024-O.

9. A method as claimed in claim 1, said apparatus being a vertical casting apparatus.

10. A method as claimed in claim 1, said apparatus being a horizontal casting apparatus.

11. A method as claimed in claim 1, the inner periphery of the ring being exposed to temperatures in the liquidus-solidus temperature range of the aluminum or aluminum alloy being cast.

* * * * *